United States Patent [19]

Arzberger et al.

[11] 4,161,971

[45] Jul. 24, 1979

[54] DISPENSER FOR PERISHABLE BEVERAGES

[75] Inventors: William Arzberger, Medfield; Merle S. Brown, Cohasset, both of Mass.

[73] Assignee: Jet Spray Corp., Waltham, Mass.

[21] Appl. No.: 827,954

[22] Filed: Aug. 26, 1977

Related U.S. Application Data

[63] Continuation-in-part of Ser. No. 697,923, Jun. 21, 1976, abandoned.

[51] Int. Cl.[2] ..... B67D 5/62

[52] U.S. Cl. ..... 141/362; 222/146 C; 222/509

[58] Field of Search ..... 222/75, 183, 185, 190, 222/146 C, 509, 559, 146 R, 146 H, 146 HE, 478, 479, 566; 141/298, 299, 362; 403/186, 389; 251/357; 62/392, 394

[56] References Cited

U.S. PATENT DOCUMENTS

| | | | |
|---|---|---|---|
| 1,526,101 | 2/1925 | Sund | 222/509 X |
| 1,965,877 | 7/1934 | Bost | 222/131 X |
| 2,176,988 | 10/1939 | Cameron | 222/185 |
| 3,089,715 | 5/1963 | Fairgrieve | 403/186 X |
| 3,255,609 | 6/1966 | Jacobs et al. | 62/394 X |
| 3,360,956 | 1/1968 | Gordon | 222/146 R |
| 3,435,992 | 4/1969 | Tisdale et al. | 222/146 R |
| 3,822,565 | 7/1974 | Arzberger | 62/392 |
| 3,920,163 | 11/1975 | Brown | 222/190 |
| 4,034,897 | 7/1977 | Brown | 141/298 X |

FOREIGN PATENT DOCUMENTS

| | | | |
|---|---|---|---|
| 377521 | 6/1964 | Switzerland | 403/389 |

*Primary Examiner*—Robert J. Spar
*Assistant Examiner*—Fred A. Silverberg
*Attorney, Agent, or Firm*—Wolf, Greenfield & Sacks

[57] ABSTRACT

A refrigerated beverage dispenser particularly designed to handle perishable beverages such as milk wherein the bowl has an opening in the bottom wall through which a spout extends that is part of the outlet tube mounted in the bowl and submerged in the beverage. The outlet tube is made of a good heat conductive material such as brass and the refrigerated beverage in the bowl is circulated over the surface of tube to maintain the tube temperature at the temperature of the beverage. A valve is mounted in the outlet tube, and a port is provided in the outlet tube upstream of the valve through which beverage in the bowl may discharge through the spout. A push handle mounted outside the bowl is connected to a push rod that extends through a tubular support in the bowl, and the push rod is coupled to the valve.

16 Claims, 4 Drawing Figures

DISPENSER FOR PERISHABLE BEVERAGES

INTRODUCTION

This application is a continuation-in-part of our copending application Ser. No. 697,923 filed June 21, 1976, now abandoned.

This invention relates to beverage dispensers and more particularly comprises a new and improved refrigerated beverage dispenser designed to handle perishable and potentially hazardous beverages such as milk.

One of the major problems in handling potentially hazardous beverages such as milk in dispensers is that a portion of the beverage may remain in an unrefrigerated part of the dispensing system and spoil, which creates a health hazard. This problem is recognized by the National Sanitation Foundation which has established standards for dispensers. Those standards require that dispensers be capable of maintaining the beverage and all dispenser surfaces in contact with it at 45° F. or less, in a 100° F. environment.

The standards imposed by the National Sanitation Foundation are particularly difficult to meet in the valve assemblies of dispensers and more particularly in those portions of the valve assemblies which are actually exposed to room temperature. The problem is even more acute in relatively inexpensive counter top dispensers where highly sophisticated and expensive valves are not suitable.

The principal object of this invention is to provide a simple valve assembly for beverage dispensers, which can maintain all the beverage in the dispenser including any residue trapped in the valve as well as all of the dispenser surfaces in contact with the beverage at 45° F. or below.

In accordance with this invention the valve assembly includes an outlet tube which is disposed in the bowl and extends through an opening in the bowl bottom wall. The tube is made of a highly conductive material such as brass. Because the tube is submerged in the refrigerated beverage which preferably is being circulated in the bowl, it quickly assumes and maintains the beverage temperature. The tube is provided with an inlet port in the bowl, which permits beverage to enter the tube. A valve is movable in the tube and cooperates with a seat in the tube disposed downstream of the discharge port for opening and closing the outlet tube. The top of the valve is connected by a link to the top of a push rod which extends through a tubular support in the bowl to the bowl exterior. A push handle in turn mounted beneath the bowl is connected to the bottom of the push rod. The connecting link is designed for easy removal from the valve and push rod for ease of cleaning.

These and other objects and features of this invention will be better understood and appreciated from the following detailed description of two embodiments thereof, read in connection with the accompanying drawing.

BRIEF FIGURE DESCRIPTION

DETAILED DESCRIPTION

Figure 1:
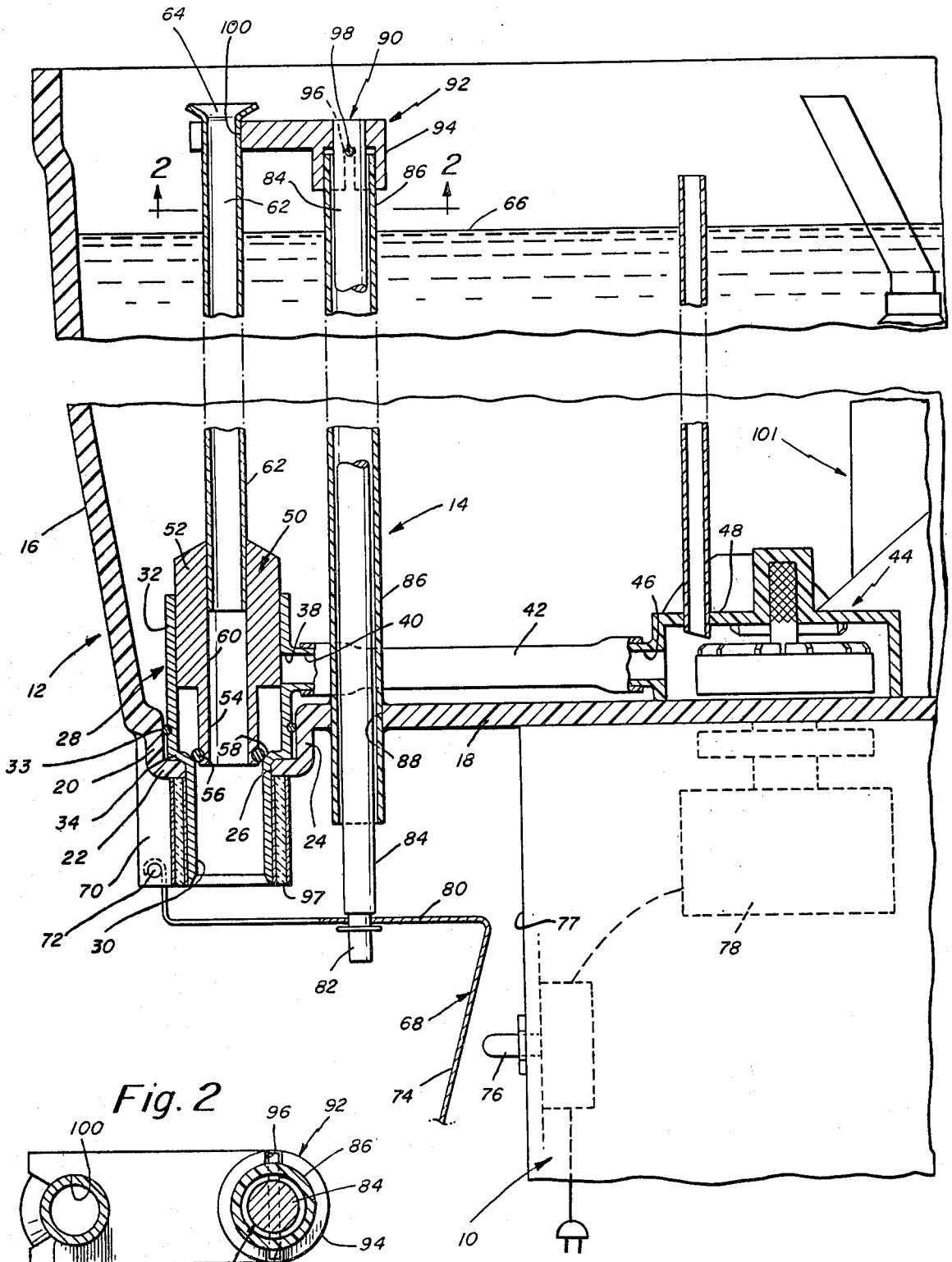
FIG. 1 is a fragmentary cross-sectional view of a beverage dispenser constructed in accordance with one embodiment of this invention.
Figure 2:
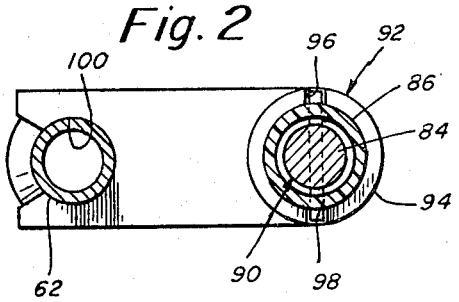
FIG. 2 is a view of the link detail of the dispenser.

The present invention typically has application in beverage dispensers such as shown in the U.S. Pat. No. 3,920,163 dated Nov. 18, 1975 entitled BEVERAGE DISPENSER WITH IN-BOWL WHIPPER and U.S. Pat. No. 3,360,956 dated Jan. 2, 1968 entitled CIRCULATION SYSTEMS FOR BEVERAGE DISPENSERS. The dispenser shown in FIGS. 1 and 2 is in fact the dispenser of U.S. Pat. No. 3,920,163, modified to include the improvement of this invention.

The dispenser illustrated includes a base 10, bowl 12 supported on the base and valve assembly 14. The portion of the bowl shown includes front wall 16 and bottom wall 18. The bottom wall 18 rests on base 10 and a condensate tray (not shown) may be provided on the base and in direct contact with the bowl.

A well 20 is formed in the front portion of the bottom wall 18 of the bowl immediately adjacent bowl front wall 16. The well 20 is generally cylindrical in shape and includes a bottom 22 and cylindrical side wall 24. An opening 26 is provided in the bottom wall 22 of well 20, and an outlet tube 28 is seated in the well. In this embodiment, the tube includes a spout 30 that extends out of the bowl through opening 26. The outlet tube 28 also includes an upper portion that serves as a valve support sleeve 32, which is of somewhat greater diameter than spout 30 and which is positioned in bowl 12 submerged in the beverage which fills the bowl. The shoulder 34 of the outlet tube rests on the bottom wall 22 of the well, and an O-ring 36 provides a seal between the upper portion of the outlet tube and the bowl to prevent beverage from leaking through opening 26 and about tube 28. It will be appreciated that the outlet tube 28 may be removed from the bowl by first disconnecting the other elements fastened to it and then lifting it upwardly out the top of the bowl.

A discharge port 38 is provided in the side of the upper portion 32 of the outlet tube and may include a nipple 40 to which flexible tubing 42 may be connected, which joins the in-bowl whipper assembly 44. The in-bowl whipper assembly 44 may be identical to that shown in U.S. Pat. No. 3,920,163 supra, and its details do not form part of the present invention.

In the drawing the flexible tubing 42 is shown joining the discharge port 46 of the whipper housing 48 and the nipple 40 about port 38 on the outlet tube 28. It is, of course, to be understood that there is an inlet port (not shown) which allows beverage in the bowl to enter the whipper assembly and flow out port 46 and tube 42 and through port 38 into the discharge tube 28.

Valve 50 having an upper enlarged portion 52 and a lower portion 54 of reduced diameter is slidable in the upper portion (valve support sleeve) 32 of the outlet tube. O-ring 56 carried at the bottom of lower portion 54 of the valve cooperates with a valve seat 58 at the top of spout 30 to control flow of beverage from the bowl out port 38 and down through the outlet tube. In the position shown, O-ring 56 forms a seal with the seat to prevent flow through the tube.

In this embodiment a vent passage 60 extends axially through valve 50 and is open to the atmosphere through the spout 30 of outlet tube 28. The valve in turn carries a vent tube 62 that extends upwardly to a level above the maximum liquid level in the bowl. As shown in the drawing, the top 64 of vent tube 62 is disposed above the level 66 of the beverage. Passage 60 and vent tube 62 thus provide continuous venting for the valve assembly 14.

The valve 50 is controlled by valve actuator 68 in the form of a push handle which is pivotally supported on the flange 70 forming part of bowl 12. As shown in the drawing, the push handle 68 is connected to flange 70 by means of a pin 72 that forms the pivotal support for it. The lower end 74 of the push handle extends generally vertically downward in front of base 10 of the dispenser and is positioned to engage a swith 76 on front panel 77 of the base and which forms part of the control circuit (not shown) of the motor 78 that drives the in-bowl whipper 44 as explained in detail in U.S. Pat. No. 3,920,163.

The horizontal arm 80 of push handle 68 is coupled to the bottom end 82 of push rod 84 that in turn extends upwardly through push rod tubular support 86, into bowl 12. The push rod tubular support is anchored in an opening 88 provided in the bottom wall 18 of bowl 12, and the support extends upwardly in the bowl above the liquid level 66. The top end 90 of push rod 84 is connected by link 92 to the top end 64 of vent tube 62. The support 86 of course prevents liquid in the bowl from leaking out opening 88.

Link 92 has a collar 94 that receives the top end of push rod support 86 to prevent the beverage in the bowl from entering the top of the support and leaking out the support through opening 88. The collar is slotted at 96 as suggested in FIG. 2 to receive the cross pin 98 carried on the top of push rod 84. A slot 100 is also provided in the link 92 which provides a snap-type fit on the vent tube 62. Thus, the link provides a dependable connection between the connecting rod and vent tube while at the same time enabling them to be conveniently disassembled for removal of the various parts from the bowl for easy cleaning.

The outlet tube 28 is made of a highly thermally conductive material such as brass, properly coated to render it suitable for use in a food vending machine. Because the tube is disposed in the cold beverage in the dispenser maintained at perhaps 35° F. by the refrigeration system, the tube serves as a heat sink to keep the external portions of the valve, that is, the outlet tube surfaces, below the prescribed temperature of 45° F. The circulation of the beverage in the bowl in contact with the tube 28 of course enhances the heat exchange relationship between the beverage and tube to maintain the tube at the beverage temperature. The circulation is caused by the evaporator-circulator 101 in the bowl which may be identical to that shown in U.S. Pat. No. 3,822,565 dated July 9, 1974. Its details are not part of the present invention. The lower end of the outlet tube, that is spout 30, may be surrounded by a sleeve 97 of insulating material which would assist the tube in maintaining the low temperature.

The very bottom of valve 50 defines the closure with valve seat 58, and no moving part of the valve assembly is located below the seat. Consequently, no dried product will form in the valve assembly that may cause the valve to stick in the tube. There is no opportunity for dried products to form in the valve assembly which would interfere with the valve because the spout is open and unobstructed and fully vented. The valve 50 itself typically is made of stainless steel. Because the valve is fully vented through vent passage 60 and vent tube 62, the beverage will flow rapidly from the bowl through the outlet tube. There is no opportunity for a partial vacuum to form in the valve assembly which would retard flow.

In the beverage dispenser shown, the push handle is positioned with respect to the switch 76 so as to cause the switch to close after the valve in the outlet tube is open when the handle is pushed toward base 10, and conversely, when the handle is released, the switch 76 is opened before the valve closed. Of course the particular valve assembly of this invention is not confined to use in a system wherein the in-bowl whipper is employed. Rather, the valve assembly has application in other beverage dispensers. When no in-bowl whipper is used, the outlet port 38 can be in direct communication with the contents of the bowl and all flow may be gravity induced.

Figures 3, 4:
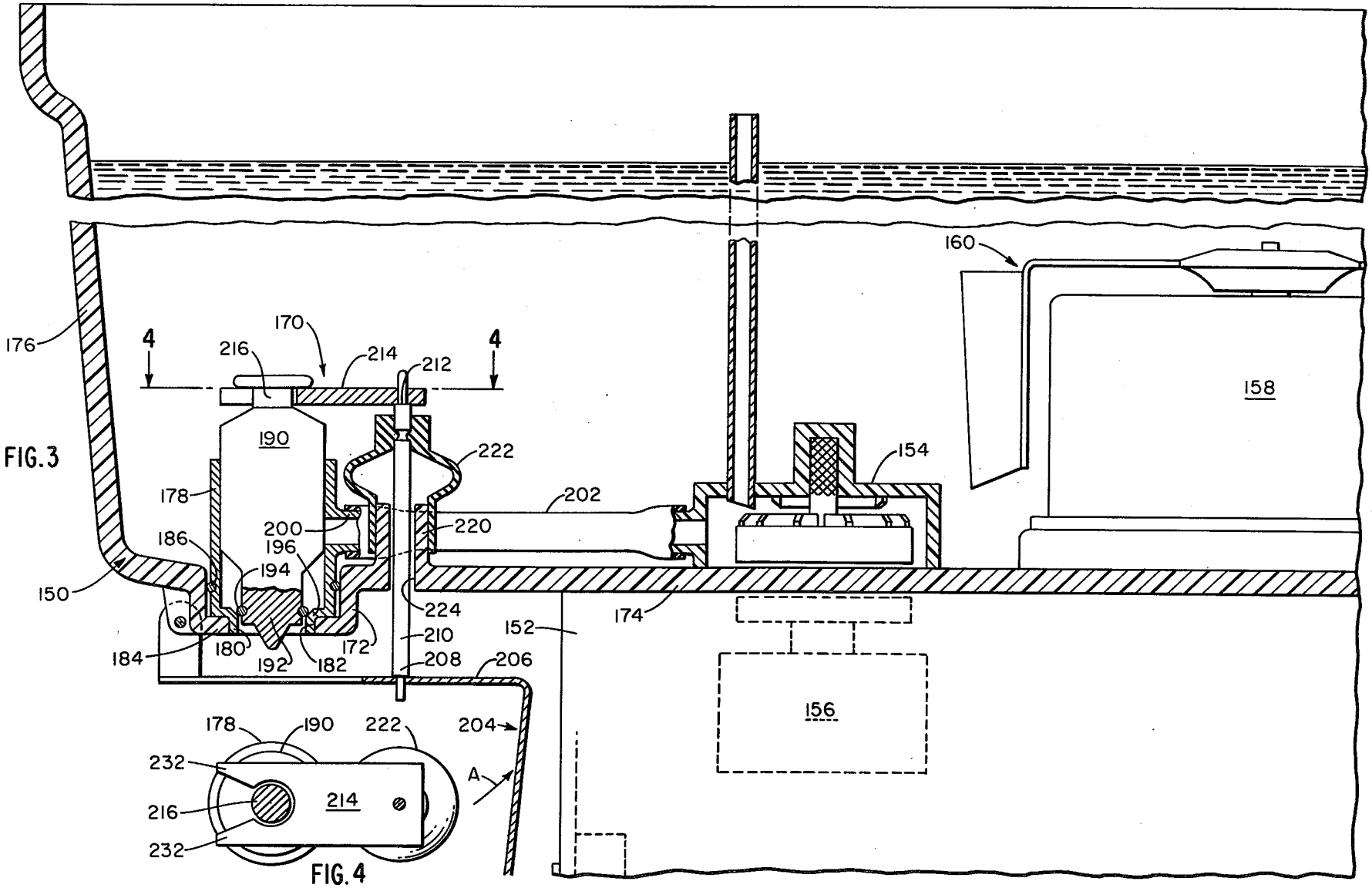
FIG. 3 is a fragmentary cross-sectional view of a beverage dispenser constructed in accordance with the preferred embodiment of this invention.
FIG. 4 is a view of the link detail of the dispenser of FIG. 3.

In the preferred embodiment of FIGS. 3 and 4, the dispenser is very similar to that shown in FIGS. 1 and 2. The bowl 150 rests on the base 152 and a whipper 154 disposed in the bowl is driven by motor and magnet assembly 156. Refrigeration means in the form of an evaporator dome 158 extends from the base 152 into the bowl 150 through an opening (not shown) provided in the bottom wall of the bowl, and a paddle wheel circulator assembly 160 causes the liquid in the bowl 150 to circulate about the evaporator 158 to efficiently reduce the temperature of the liquid in the bowl. The evaporator 158 and circulator 160 may be identical to that shown in U.S. Pat. No. 3,360,956. The rest of the refrigeration system of which the evaporator forms but one part is contained in the base. The whipper assembly 154 identical to that shown in the first described embodiment is the same as the whipper shown in U.S. Pat. No. 3,920,163 supra.

The preferred embodiment differs from the first described embodiment in the construction of the valve and actuator assembly 170.

A shallow well 172 identical to the well 20 of the first embodiment is formed in the bottom wall 174 of bowl 150 adjacent front wall 176. An outlet tube 178 is seated in well 172 with its lower end 180 of reduced diameter extending through the opening 182 provided in the bottom wall 184 of well 172. An O-ring 186 surrounds the lower portion of tube 178 and forms a seal with the inner surface of the cylindrical wall 188 that defines well 172.

The outlet tube 178 is made of a highly conductive material such as brass. While other materials may be used, it is important that the tube be a good thermal conductor so that it may maintain a temperature substantially equal to that of the liquid in bowl 150 within which it is submerged. Circulator 160 which causes the beverage refrigerated by the evaporator 158 to move about the bowl creates an effective heat exchange relationship between the beverage and the outlet tube. The beverage serves as a heate sink for the sleeve so that any heat absorbed by the tube particularly at its lower end may readily be dissipated into the circulating beverage. Because of the importance of this characteristic of the tube, a tube made of stainless steel for example, which is a poorer heat conductor than brass would produce an inferior result than the tube made of brass.

Valve 190 is slidably disposed in tube 178 and has a lower portion 192 of reduced diameter which carries an O-ring 194 that is designed to form a seal at the shoulder 196 formed at the top of the lower section 180 of tube 178. Thus, when the valve 190 is in the position shown in FIG. 3, the O-ring 194 rests on the shoulder or seat 196 so as effectively to close the valve. As in the first described embodiment, tube 178 carries a nipple 200 to which is connected the duct 202 leading from the whipper assembly 154.

The valve 190 is actuated by push handle 204 having a horizontal arm 206 connected to the lower end 208 of push rod 210. The upper end 212 of push rod 210 is connected to link 214 which in turn is connected to the upper end 216 of valve 190. Push rod 210 extends through sleeve 220 formed as a cylindrical wall in the lower wall 174 of the bowl, and the sleeve guides the motion of the push rod in an axial direction. A bellows 222 is connected to the upper end of the sleeve 220, and the upper end of the bellows in turn is sealed to the upper portion 212 of the push rod. Thus, the bellows 222 serves both to seal the opening 224 in the sleeve through which the push rod extends and also serves as a spring to return the push rod to the lower position as shown in the drawing. When the push handle is pivoted in the direction of arrow A the push rod 210 is elevated in sleeve 220 against the bias of the bellows, and the link on the top of the rod moves the valve 190 up with it and thereby opens the valve by unseating O-ring 194 from shoulder 196. When the push handle is released, it pivots back to the position shown and the valve seats in the closed position illustrated.

It will be apparent from the foregoing description that assembly 170 can readily be disassembled for cleaning. The link 214 whose slotted end 230 engages the upper end 216 of the valve may be disconnected readily from the valve by the snap action of the arms 232 that define the slot. Moreover, link 214 may be removed from the upper end of push rod 210 by being lifted off the upper portion 212. The bellows may be removed from sleeve 220, and valve 190 and sleeve 178 may separately be removed from the bowl so that all of the elements may be cleaned.

It is important to recognize that the tube 178 which itself is made of a highly conductive material is kept at a reduced temperature by the circulating beverage in the bowl in which it is submerged. Thus, the tube 178 forms a refrigerated outlet so that any liquid in the tube is maintained at the reduced temperature to retard the buildup of bacteria, etc. That the sleeve is made of a highly conductive material, that it extends into the beverage, and that the beverage itself circulates about the sleeve all contribute to the efficiency of the system.

It will be appreciated that the valve assemblies of this invention accomplish all the recited objects of this invention. It serves to maintain all of the parts in contact with the beverage at the low temperature required by the National Sanitation Foundation standards. Moreover, the valve assembly may be very quickly disassembled for cleaning.

Because modifications may be made of this invention without departing from its spirit, it is not intended that the breadth of the invention be limited to the specific embodiment illustrated and described. For example, while in the present invention the push handle 68 is shown to actuate the valve through the push rod and link (and vent tube, in one embodiment) it is to be understood that other systems may be employed for the same purpose. While the embodiment of FIGS. 3 and 4 is preferred, other techniques may be employed as well. Therefore, the breadth of this invention is to be determined by the appended claims and their equivalents.

What is claimed is:

1. A refrigerated beverage dispenser comprising a base and a bowl on the base for storing refrigerated beverage, a first opening in the bottom of the bowl, an outlet tube mounted in the bowl and registering with the opening and with at least the major portion of its length being submerged in the refrigerated beverage when the bowl is filled with beverage, said tube being made of a material having a high thermal conductivity so as to provide a good heat exchange relationship between the beverage and the tube, allowing the tube to achieve the temperature of the beverage, a valve movable in the outlet tube within the portion of the tube positioned to be submerged in the beverage in the bowl, a port in the major outlet tube portion through which beverage in the bowl is discharged into and through the tube, a valve seat in the outlet tube downstream of the port and cooperating with the valve to control the discharge of beverage from the bowl, and an actuator operatively connected to the valve for unseating it from the valve seat to permit discharge of beverage from the bowl.

2. A dispenser as described in claim 1 wherein refrigeration means is operatively connected to the bowl for cooling the beverage in the bowl, and a circulator is disposed in the bowl for circulating the beverage in contact with the outlet tube to reduce the temperature of the tube.

3. A dispenser as described in claim 1 further characterized by a second opening in the bowl bottom, a push rod forming part of the actuator and operatively connected to the valve, and movable up and down in the second opening and extending out of the bowl, and a handle outside the bowl and connected to the rod.

4. A refrigerated beverage dispenser as defined in claim 3 further characterized by a bellows connected to the push rod and bowl for sealing the second opening to prevent beverage leaking from the bowl through said second opening.

5. A refrigerated beverage dispenser as described in claim 3 further characterized by a bellows secured to the bowl about the second opening and to the push rod for sealing the second opening so as to prevent beverage in the bowl from leaking out through that opening.

6. A refrigerated beverage dispenser as described in claim 5 further characterized by a detachable link joining the top of the valve and the push rod.

7. A beverage dispenser comprising a bowl for storing refrigerated beverage, cooling and circulating means in the bowl for the beverage, an opening in the bowl, an outlet tube made of a highly thermal conductive material removably mounted in the bowl and having a discharge end registering with the opening, substantially the full length of the tube being positioned in the bowl to be submerged in the refrigerated and circulating beverage in the bowl, the provide a good heat exchange relationship between the beverage and tube so that the tube can achieve the temperature of the beverage, said outlet tube defining a passage through which beverage in the bowl may be discharged, a seal between the tube and the inner surface of the bowl, a port in the tube that is disposed within the bowl for beverage to flow into the tube, a valve and seat in the tube downstream of the port for opening and closing the passage, and a valve actuator exterior of the bowl and connected to the valve.

8. A dispenser as defined in claim 7 further characterized by said discharge end extending below the bowl, and an insulation sleeve covering the portion of the tube exterior the bowl to isolate the tube from the ambient temperature.

9. A beverage dispenser as defined in claim 7 further characterized by said tube being made of brass or similar material having a comparable thermal conductivity.

10. A dispenser as described in claim 9 further characterized by said valve having a cylindrical body movable up and down in the tube within the bowl, and an O-ring shut-off seal carried on the body and cooperating with the seat to control flow from the bowl through the passage.

11. A dispenser as described in claim 10 further characterized by a cylindrical well formed in the bottom of the bowl, and said opening being formed in the bottom of the well and with the seal between the tube and bowl lying within the well.

12. A dispenser as described in claim 11 further characterized by a vent passage in the valve body and extending vertically therethrough, a vent tube mounted in the passage and extending upwardly in the bowl above the maximum beverage level in the bowl, and said actuator being connected to the valve body by means of the vent tube.

13. A dispenser as described in claim 12 further characterized by a tubular support mounted in and extending through the bottom of the bowl and with its upper end disposed above the maximum beverage level in the bowl, a push rod slidable in the support, a link in the bowl releasably connected to the top of the rod and to the vent tube, and said actuator including a push handle mounted on and disposed below the bowl and connected to the push rod.

14. A dispenser as described in claim 13 further characterized by said link including a slot for releasably engaging the top of the vent tube, a collar on the link covering the top end of the support, a second slot in the collar, and a pin in the top of the connecting rod and engaging the second slot.

15. In a dispenser as described in claim 12, said link including a slot for releasably grasping the top of the vent tube, a collar on the link covering the top end of the support, a second slot in the collar, and a pin in the top of the connecting rod and engaging the second slot.

16. In a dispenser, a bowl for storing refrigerated beverage, an opening in the bowl, an outlet tube made of a highly thermal conductive material removably mounted in the bowl with a spout extending through the opening, a seal between the tube and the inner surface of the bowl, said tube designed to be submerged in the refrigerated beverage in the bowl, a discharge port in the tube within the bowl for beverage to flow into the tube and out the spout, a valve and seat in the tube downstream of the port for preventing flow of beverage from the bowl, a valve actuator exterior of the bowl and connected to the valve, said valve comprising a cylindrical plunger movable up and down in the tube within the bowl, and an O-ring shut-off seal carried on said plunger cooperating with the seat of said valve to control flow from the bowl, said opening being formed in the bottom of the well with an O-ring within the well forming the seal between the tube and bowl, a vent passage in the valve plunger and extending vertically therethrough, a vent tube mounted in the passage and extending vertically in the bowl above the maximum beverage level in the bowl, said actuator being connected to the valve plunger by the vent tube, a tubular support mounted in and extending through the bottom of the bowl and with its upper end disposed above the maximum beverage level in the bowl, a push rod slidable in the support, a link in the bowl releasably connected to the top of the rod and to the vent tube by slotted collars, and said actuator including a push handle mounted on and disposed below the bowl and connected to the push rod.

* * * * *